United States Patent [19]

Robinson

[11] Patent Number: 5,056,716

[45] Date of Patent: Oct. 15, 1991

[54] TANK WASHER

[75] Inventor: Michael Robinson, Cheltenham, United Kingdom

[73] Assignee: Breconcherry Limited, Herefordshire, England

[21] Appl. No.: 482,244

[22] Filed: Feb. 20, 1990

[30] Foreign Application Priority Data

Feb. 20, 1989 [GB] United Kingdom ..... 8903775

[51] Int. Cl.[5] ..... B05B 3/14

[52] U.S. Cl. ..... 239/227; 239/228; 239/239; 239/263.3; 134/168 R

[58] Field of Search ..... 239/227, 228, 237, 238, 239/239, 243, 244, 246, 263, 263.3; 134/168 R; 118/55

[56] References Cited

U.S. PATENT DOCUMENTS

| | | | |
|---|---|---|---|
| 3,175,768 | 3/1965 | Hammelmann | 239/239 |
| 3,437,271 | 4/1969 | Hammelmann | 239/227 |
| 3,625,425 | 12/1971 | Robinson | 239/227 |
| 3,696,825 | 10/1972 | Guignon et al. | 134/167 R |

FOREIGN PATENT DOCUMENTS

| | | | |
|---|---|---|---|
| 0172689 | 2/1986 | European Pat. Off. . | |
| 316930 | 5/1989 | European Pat. Off. | 239/239 |
| 1208989 | 1/1966 | Fed. Rep. of Germany | 239/239 |
| 1369825 | 1/1988 | U.S.S.R. | 239/237 |

*Primary Examiner*—Andres Kashnikow
*Assistant Examiner*—Karen B. Merritt
*Attorney, Agent, or Firm*—Harness, Dickey & Pierce

[57] ABSTRACT

A washer is described for cleaning the interiors of tanks that hold milk, beer, chemicals and so on. A body 2 reciprocates relative to a substantially surrounded and relatively fixed piston 19. The body 2 oscillatably supports three nozzles 7 each of which is movable through an arc of 60° and which arc is angularly spaced from those corresponding to the other two nozzles 7 by further angles of 60°. However, the body 2 and nozzles 7 are also indexed, during operation, in steps, around a further axis which is perpendicular to, and offset from the axis of oscillation and which substantially corresponds to the longitudinal axis of the tank washer itself. Thus, each nozzle 7 cleans not only an arc of 60° but rotates that arc through 360° so that the whole of the interior of a tank is both washed and substantially rinsed by the three nozzles 7.

10 Claims, 5 Drawing Sheets

TANK WASHER

FIELD OF THE INVENTION

Industrial storage tanks that contain liquid need to be cleaned. This is to remove the deposits left by the product or to clean the tank so that a different product can be loaded therein without contamination from the previous product.

BACKGROUND TO THE INVENTION

The method which is the subject of this invention is to spray the inside surfaces of a tank with jets of detergent and subsequently with jets of detergent and water is effected rinsing water. The distribution of such jets of detergent and water is effected by a tank washer.

A tank washer is a mechanical device which directs the jets of detergent or water in a predetermined pattern over the inside surfaces of a tank which is to be cleaned. The tank washer is operated by the detergent solution or rinsing liquid that passes through it and will run automatically when fed with such liquid. It needs to be clean in design so that it can be left in the product in a tank without contaminating that product. It also needs to be robust if it is to be moved from tank to tank without damage. Such features are part of the design of a tank washer in accordance with this invention.

Typical tanks that are often cleaned by known tank washers are those employed in breweries, milk processing plants, paint factories and other installations where bulk liquids are stored.

SUMMARY OF THE INVENTION

According to the invention, there is provided a tank washer comprising a piston immovably connected, in operation, to liquid supply means, a body reciprocably surrounding said piston and at least one liquid ejection nozzle oscillatably connected to said body, and a mechanism operable by the relative reciprocation between the body and the piston to index the body around an axis.

The views and details shown in the accompanying drawings assume throughout that the tank washer in accordance with the invention is hanging substantially, vertically in a tank to be cleaned and that it is fed with both cleaning and rinsing liquid from a centrifugal pump connected to a storage tank of such liquid or to the mains in the case of rinsing water. A tank washer in accordance with the invention could equally well, however, be inverted or have a horizontal or even an inclined disposition.

BRIEF DESCRIPTION OF THE DRAWINGS

For a better understanding of the invention, and to show how the same be carried into effect, reference will now be made, by way of example, to the accompanying drawings, in which.

PARTICULAR DESCRIPTION

Figure 3:
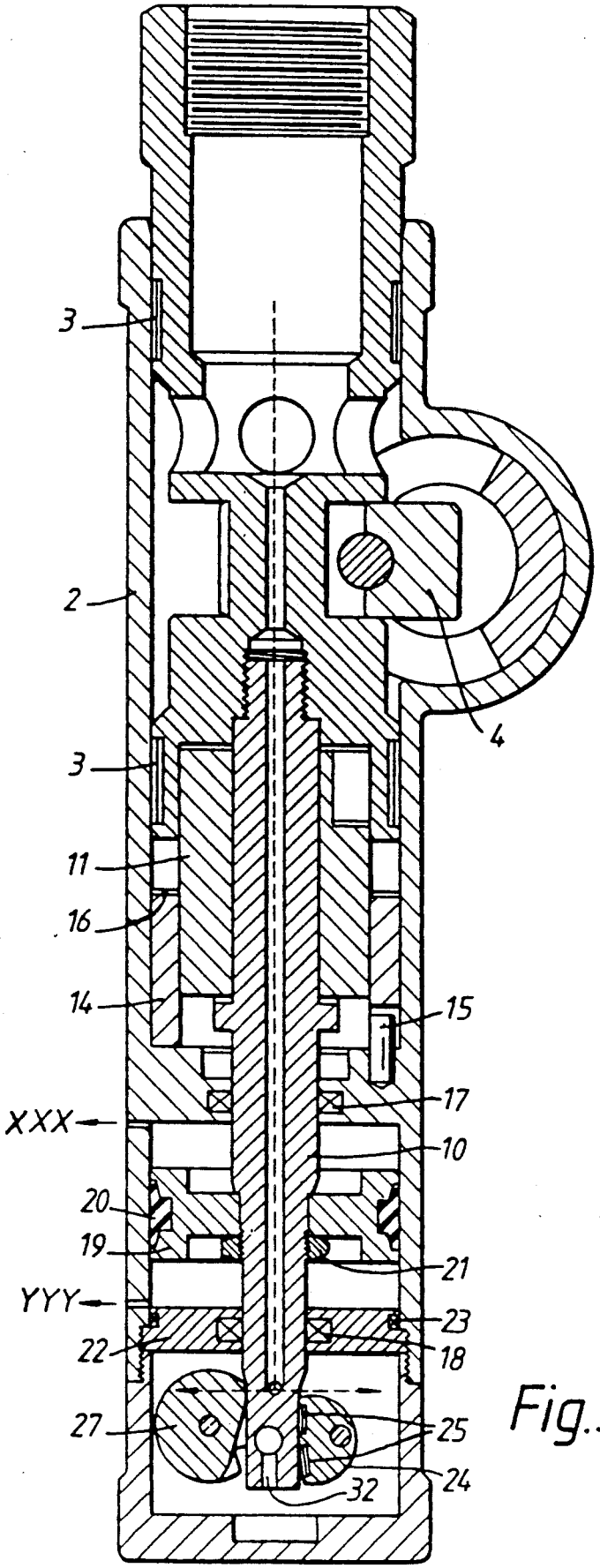
FIG. 3 is a section on the line III—III of FIG. 1.
Figure 4:
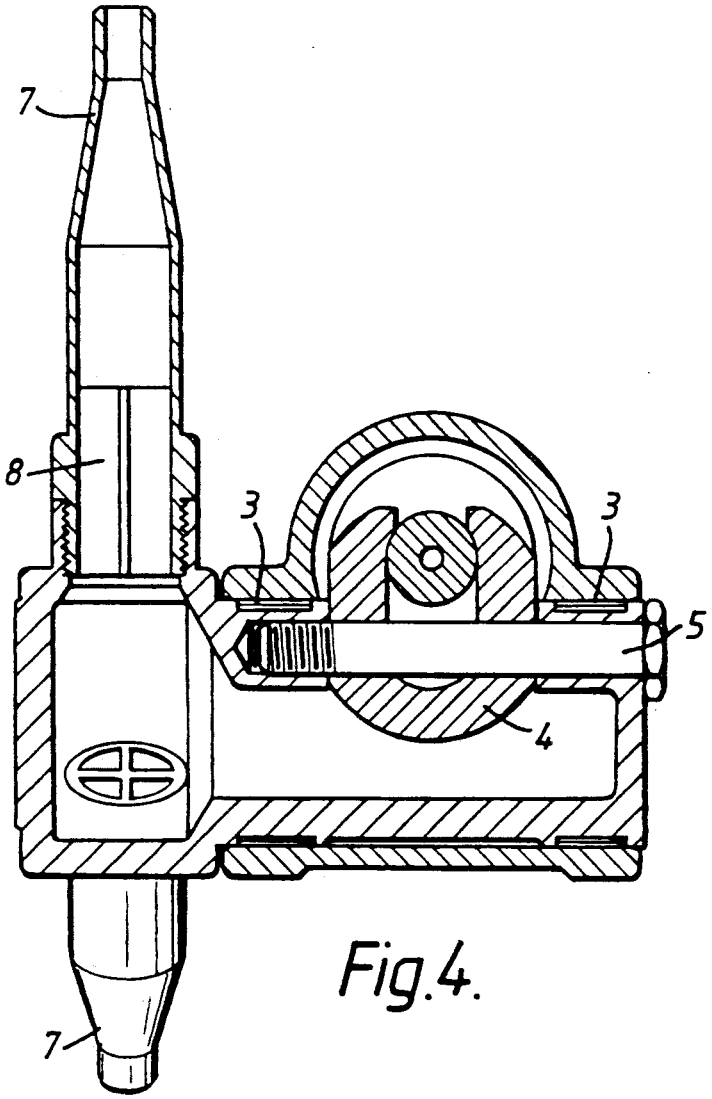
FIG. 4 is a section on the line IV—IV of FIG. 1, looking downward.
Figure 10:
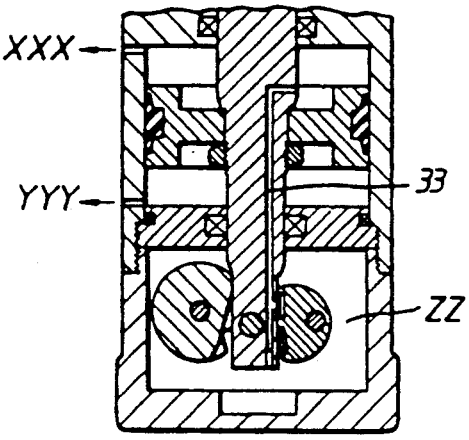
FIG. 10 is a part section again taken on the line III—III but the purpose of this view is to show water passages for liquid operating the tank washer. It is a part section X—X in FIG. 9.
Figure 11:
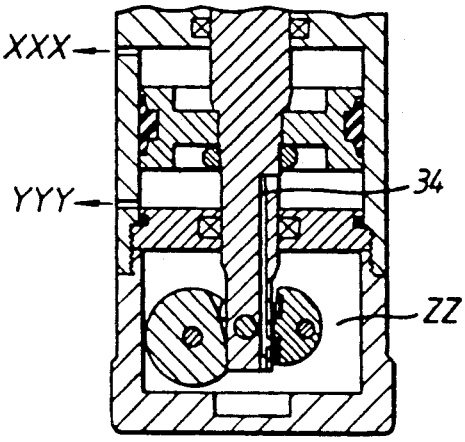
FIG. 11 is another part section displaced slightly to show the second of two water flow passages. It is again a part section XI—XI in FIG. 9.

It is noted that FIGS. 3, 10, and 11 also show bleed holes XXX and YYY. These holes form part of the operating system of the tankwasher and are calibrated holes having ports of a size that determine the speed of operation of the tank washer. They will be described in greater detail below.

A tank washer in accordance with the invention is secured by means of the internal screw thread of an inlet tube 1. The bulk of the detergent solution, and the subsequent rinsing liquid, which will amount to substantially 95° thereof, flows through the tank washer tank unit and directly out of that unit through three liquid ejection nozzles 7. A line carrying directional arrows indicates this arrangement in FIG. 2 of the drawings. The remaining approximately 5% of the detergent solution or rinsing liquid is directed downwardly through a small passage located centrally in the base of the inlet tube 1 and effects the operational movements of parts of the tank washer. A broken line indicates this arrangement in FIG. 3 of the drawings.

The operating mechanism of the tank washer oscillates the three nozzles 7 thereof through an arc of 60°. At each oscillation of each nozzle 7, the tank washer as a whole indexes in steps about a vertical axis and, typically there will be 36 of these steps to turn the nozzle 7 through a single complete revolution about the vertical centre line of the tank washer, each "step" thus having a magnitude of substantially 10° .

Figure 1:
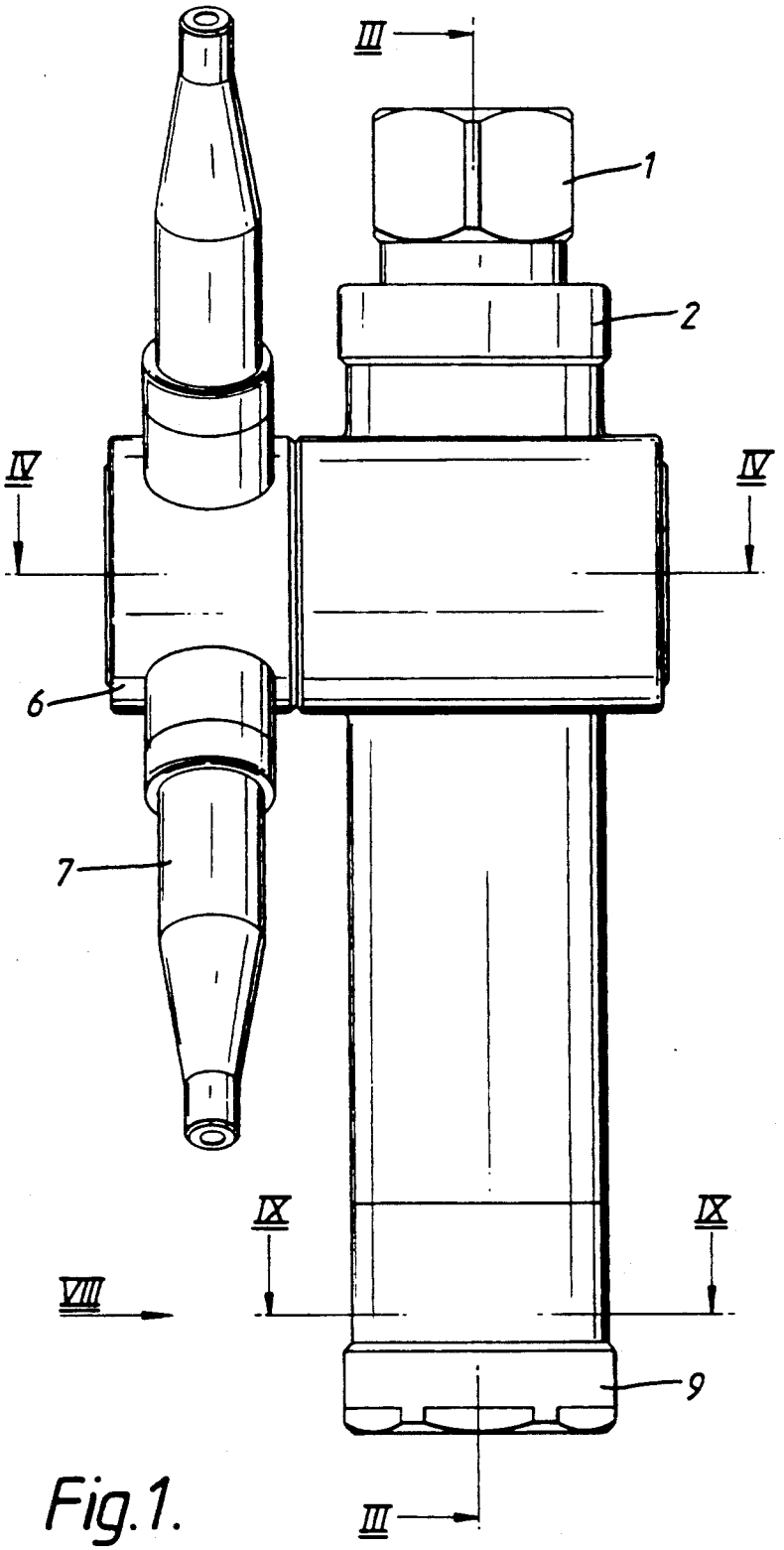
FIG. 1 is an external view of a tank washer in accordance with the invention. Ejection nozzles of the tank washer are shown approximately centrally of their arcs of oscillatory movement.
Figure 2:
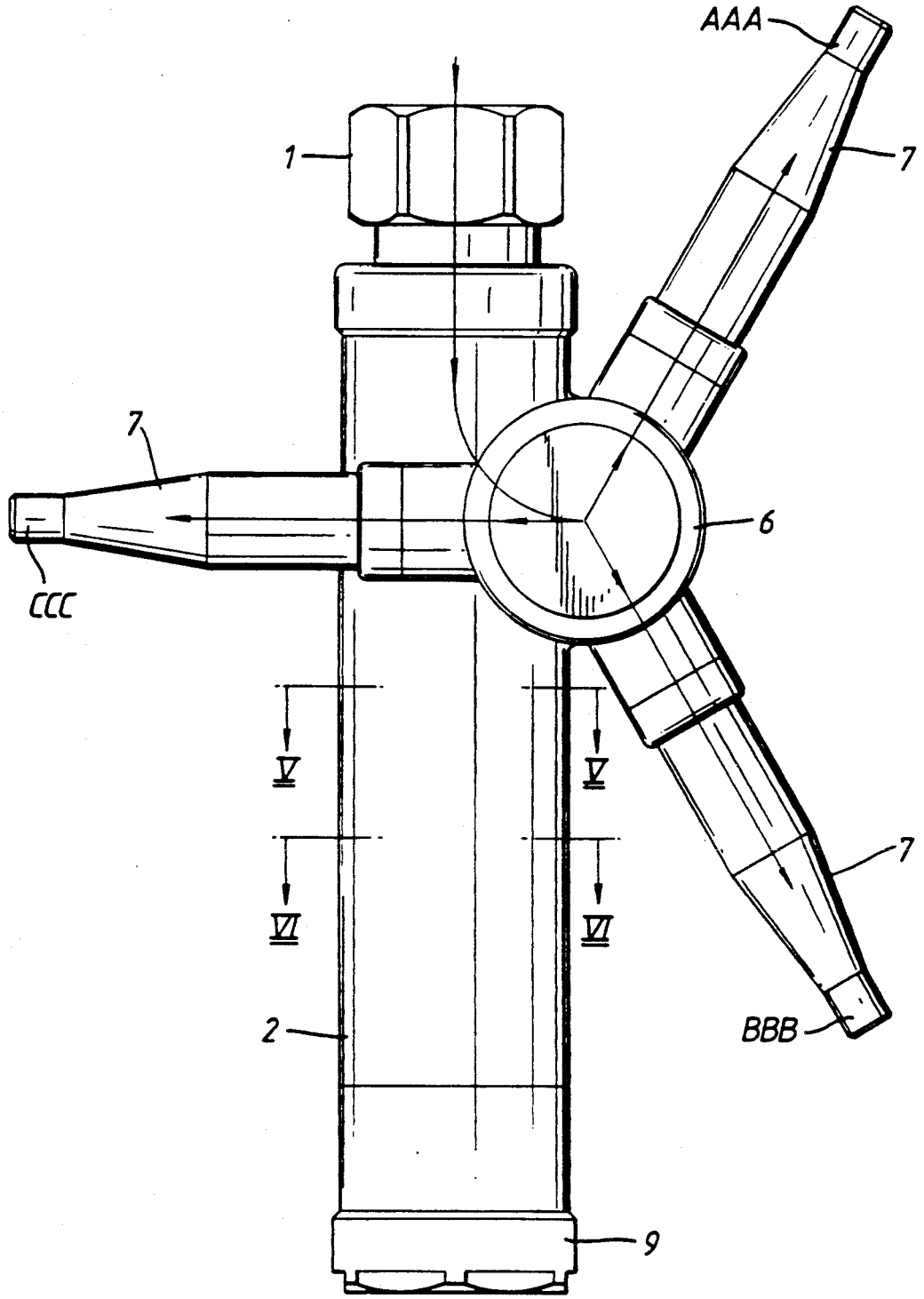
FIG. 2 is a left hand side view of the tank washer of FIG. 1.

The nozzles 7 have, in FIG. 2 of the drawings been additionally marked AAA, BBB and CCC, respectively. The jets of liquid which issue from them each cover substantially 60° so that the three jets together cover substantially 180°, there being 60° intervals between the three arcs of coverage. However, since the jets AAA, BBB and CCC also index progressively around a substantially vertical centre line through 360°, each jet arc actually covers 120°, rather then the 60° which would be covered if no indexing took place. Thus, the three arcs of coverage together cover 360° so that the total coverage of the inside surface of tank which is being cleaned is attained.

The tank washer that is being described pumps upwardly and downwardly in addition to progressively rotating, by indexed steps, about a vertical axis substantially coinciding with its own longitudinal axis. Several central parts of the tank washer do not move, during operation, relative to the liquid inlet tube 1. Although initially separate, these parts could be considered as being a single entity. Other parts of the tank washer move upwardly and downwardly during the operation of the latter.

As previously mentioned, the inlet tube 1 is secured, usually by screw-threads, to a pipe which is fixed to the tank that is to be cleaned and that supplies the cleaning liquid and subsequently the rinsing liquid to the tank washer and the interior of the tank. Bearing sleeves 3 which may be made from polytetrafluoroethylene filled polymer are fitted in circumferential grooves in the inlet pipe 1 and are lubricated by the supplied liquid. They act as seals preventing leakage of the liquid to the exterior. Although not shown in the drawings, the seal could be made even better, when required, by fitting the bearing with known nitrile 0-rings.

A main body 2 of the tank washer is fitted over the bearing sleeves 3 and is a single stainless steel casting forming the principal structural frame of the tank washer. A nozzle tube 6 is fitted in a cross tube located between the sleeves 3. The previously mentioned three nozzles 7 are fitted to the nozzle tube 6 so as to project radially therefrom at 120° intervals around the longitudinal axis of the tube 6. Each of the nozzles 7 is fitted with flow guides 8 to improve the "throw" of the jets which issue from it during use. The inlet . tube 1 and nozzle tube 6 are linked together within the main body 2 by a coupling piece 4 that is secured to the nozzle tube 6 by a bolt 5.

During operation, the main body 2 moves upwardly and downwardly on the relatively fixed inlet tube 1 and is guided in its axial reciprocation by the bearing sleeves 3. The coupling piece 4 moves freely within a large groove in the inlet tube 1 and transmits to the nozzle tubes 6 the 60° oscillation that is derived from this movement, said movement being in the form of a vertical reciprocation. These movements produce the 60° oscillation of the nozzles 7 about the longitudinal axis of the nozzle tube 6 as already mentioned above and as can be seen in FIG. 2 of the drawings.

A piston rod 10 is screwed into the base of the inlet tube 1 and has a piston 19 secured to it by a lock nut 21. The piston 19 is movable in a chamber that is defined in the main body 2 and that is normally sealed closed by a cylinder cap 22, an 0-ring 23 being provided for this purpose. The exterior of the piston 19 carries a piston seal 20 which acts also as a bearing locating the piston 19 acturately within the chamber that has just been mentioned.

A differential pressure is created at opposite sides of the piston 19 and will be discussed in detail below. However, this pressure causes the main body 2 to reciprocate upwardly and downwardly with the piston 19 itself remaining in a fixed position. Since the piston 19 is fixedly secured to the inlet tube 1, it may be considered as being part of the tank that is to be cleaned. The main body 2 moves relative to this fixed piston 19 and therefore, through the intermediary of the coupling piece 4, oscillates each nozzle 7 through the 60° arc about the longitudinal axis of the tube 6 that has been discussed above. It will be remembered that the moving parts of the tank washer also index progressively in steps around an axis substantially coinciding with its own vertically disposed longitudinal axis but this movement will be discussed separately below.

The liquid which operates the tank washer follows substantially the path shown by a broken line in FIG. 3 and applies pressure successively to the opposite upper and lower surfaces of the piston 19. The piston rod 10 is sealed at either side of the piston 19 by shaft seals 17 and 18 and, as previously mentioned, the operating liquid acts to move the main body 2 upwardly and downwardly. The cylinder wall of the main body 2 is provided, at each side of the piston 19, with drilled calibrated holes XXX and YYY, the former hole being the upper one. These holes vent the cylinder space to the atmosphere internally of the tank that is being cleaned. They are "constant exhaust holes" and are substantially smaller in size than are the holes through which the liquid is directed that pressurizes the top and bottom of the piston 19. When the top of piston 19 is pressurized, some of the operating liquid will be lost to exhaust through the hole XXX but, since that hole is significantly smaller in size than is the supply to the piston 19, a pressure builds up above the piston 19. This causes the main body to move upwardly, causing the nozzles 7 to move in a clockwise direction as seen in FIG. 2. As soon as the operating liquid is no longer supplied to either side of the piston 19, the pressure will immediately fall since the liquid concerned will exhaust out of either hole XXX or hole YYY. This arrangement allows a simple flap valve that will be described below to direct the liquid to the appropriate point.

The operating liquid follows the broken path that can be seen in FIG. 3 of the drawings and moves downwardly right through the centre of the piston rod 19 and into the lower chamber ZZ that is closed by the cap 9. This chamber ZZ is connected to the spaces both above and below the piston 19 by two drilled passages 33 and 34 that can be seen in FIGS. 10 and 11 of the drawings. FIG. 10 shows how one passage 33 directs the liquid from the chamber ZZ to the space above the piston 19 through a hole in the rod 10 and FIG. 11 shows the drilling of the passage 34 through the piston rod 10 to connect the chamber ZZ in the cap 9 to the lower surface of the piston 19.

The supply of the operating liquid from the chamber ZZ to either of the two passage- ways 33 or 34 that have been mentioned above will determine whether the piston 19 will be pressurized on its upper or its lower surface and thus whether body 2 will rise or fall. The successive switching over of the flow of liquid from one passage 33 to the other 34 is controlled by a valve 24 which valve is thus very important to the whole function of the tank washer.

Figure 8:
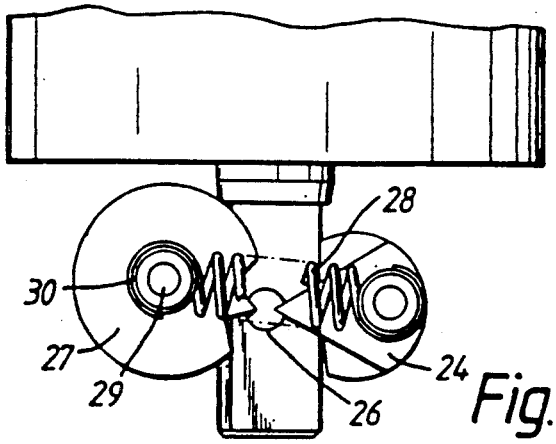
FIG. 8 is a view in the direction VIII in FIG. 1 but with a cap of the tank washer unscrewed and removed.
Figure 9:
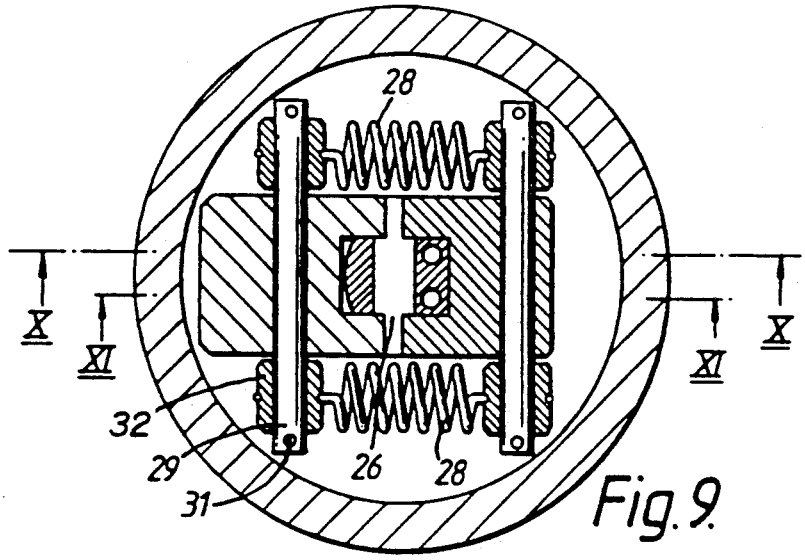
FIG. 9 is a section IX—IX taken in FIG. 1.

A pivot post 26 is fitted at right angles to the piston rod 10 and is locked in position by a grub screw (FIGS. 8 and 9). The pivot post 26 has axially extending "V" grooves milled into its surface and the valve 24 exhibits male pivot points which straddle the piston rod 10 and enable that valve to rock within female "V" grooves formed in pivot post 26. Two faces of the valve 24 are provided with rubber pads which form valve seats 25. As the valve 24 rocks progressively in opposite directions through an angle which may have a value of substantially 8° to 10°, it directs the flow of the operating liquid to each of the two passages 33 and 34 in turn which passages, as previously mentioned, lead to locations respectively above and below the piston 19.

It is a characteristic of reciprocating pistons that are operated by water or aqueous solution that a piston, such as the piston 19, cannot be used to switch the valve, such as the valve 24, directly at the end of its stroke to reverse the direction of flow. The reason for this is that, as soon as the valve 24 is moved even a small amount, the action "locks" and no further movement takes place. It is necessary that the valve 24 should receive from the piston rod 10 some energy and should store that energy and that it is then triggered so that it will move independently of the action that initiates the triggering. This is known as a "load - and fire" mechanism.

Pivotally mounted on the same pivot post 26, but at the opposite side thereof to the parts which have just been mentioned, is a flyover 27. The relationship between the flyover 27 and the valve 24 can be seen best in FIGS. 8 and 9. A spring spindle 29 is provided for each of the value 24 and the flyover 27, between the opposite ends of which tension springs 28 are arranged. These springs 28 tend to pull the flyover 27 and valve 24 together but stops on both of them limit that movement. Nylon sleeves 32 are fitted to the opposite ends of the spring spindles 29 to reduce friction and are secured in place by washers 30 (FIG. 8) and split pins 31 (FIG. 9).

With particular reference to FIGS. 3, 10 and 11, when the valve 24 occupies the position shown in FIG. 10, the operating liquid will flow from the chamber ZZ in the cap 9 through an open port to the lower surface of the piston 19. The passages 33 and 34 are slightly offset and the arrangement can be seen in FIGS. 10 and 11 of the drawings. Some of the liquid flow will be exhausted through the hole YYY but, since the incoming flow of liquid is greater then the exhaust through the hole YYY, the lower surface of the piston 19 is pressurized. The main body 2 and the parts that are attached thereto will therefore move downwardly as shown in FIG. 2. The lower surface of a cap 22 of the cylinder will eventually contact the outer diameter of the flyover 27. The latter will, as a consequence, rock over in the groove in the pivot post 26 and will tension the springs 28 to pull the valve 24 tighter on to its seat. At a certain point, which is best shown in FIG. 8 of the drawings, the spring spindle 29 of the flyover 27 will pass "dead centre" relative to the valve 24 and will snap over anti-clockwise (as viewed in FIG. 8), which will cause the valve 24 to snap over in a clockwise direction to engage the other one of the two valve seats 25. This action, it is emphasized, happens independently of the triggering of the action by the flyover 27 and is caused by the energy stored in the two springs 28. Thus, the valve 24 is "loaded and fired".

With the liquid now flowing from the chamber ZZ through the passage 33 to the upper side of the piston 19, direction of movement of the body 2 is reversed. It now rises causing the nozzles 7 to move angularly in an anti-clockwise direction as seen in FIG. 2. The flyover 27 and the valve 24 will have moved to the positions thereof that can be seen in FIG. 11. It is contact of the cap 9 with the flyover 27 which causes the flyover 27 and hence valve 24 to snap in clockwise and anti-clockwise directions respectively.

The cycle of upward and downward movement of the piston 19 that has been briefly described will continue whilst operating liquid is supplied to the tank washer causing the nozzles 7 to reciprocate to and from through their 60° arcs. However, as will be appreciated this takes place in only a single plane and, to give complete coverage, it is necessary that the movable parts of the tank washer should be indexed in steps about its longitudinal axis. An index driver 11 is fitted to the top of the piston 10 and can be seen best in FIG. 7 of the drawings. It is retained in place by a collar and is free to rotate on the relatively fixed piston 10. The upper end of the index driver 11 fits inside a recess at the lower end of the inlet 1. Three sloping grooves which can be seen best in FIG. 5 of the drawings are milled into the index driver 11 and three plain rollers 12 of circular cross-section are located in the respective three sloping grooves. The rollers 12 are urged by respective springs 13 which press them outwardly into the wedged channels formed by the corresponding sloping grooves. The effect is to form a one-way clutch between aforementioned recess in the inlet 1 and the outer diameter of the index driver 11. Thus, the index driver 11 can turn relatively freely in one direction whereas it will substantially immediately lock if an attempt is made to turn it in the opposite direction.

Figure 7:
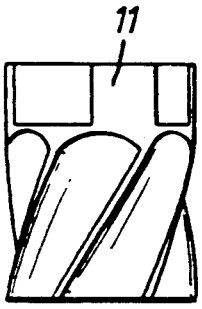
FIG. 7 is an external view of an index driver of the tank washer showing in better detail an external helix thereof.

A hexagonal spiral which can be seen best in FIG. 7 is machined into the exterior surface of the index driver 11 and typically has a pitch of 1° per one millimetre of length. The index driver 11 fits into a corresponding shaped female hexagonal sectioned hole in a scroll 14 which latter may be formed from a filled polytetrafluoroethylene material. It is moveable in the manner of a nut and bolt relative to the index driver 11 which latter may be formed from stainless steel. The two materials are chosen so that they will co-operate slidably with a minimum of friction. The operating liquid will tend to lubricate the interface between them. The scroll 14 is a tight fit in the bore of the main body 2 where it is secured by a clip 16 but is prevented from turning in the bore by the provision of a peg 15.

Figure 5:
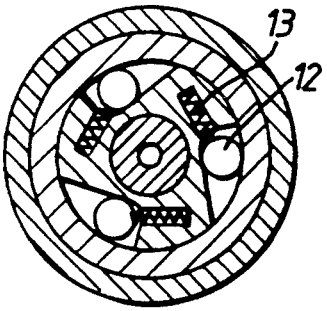
FIG. 5 is a section on the line V—V in FIG. 2, again looking downward.
Figure 6:
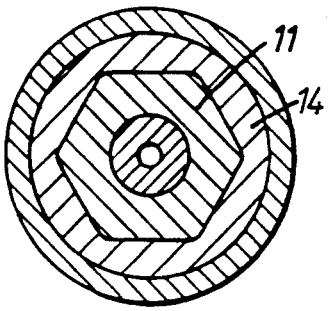
FIG. 6 is a similar view to FIG. 5 but is taken at lower level as a further section VI—VI of FIG. 2.

FIGS. 3 and 5 of the drawings best show the indexing action of the parts of the tank washer which rotate, in steps, about an axis substantially coinciding with its own vertically disposed longitudinal axis. Assuming that the main body 2 and the parts connected thereto are rising, the index driver 11 will move in relation to the scroll 14 and, because of the hexagonal spiral, will tend to rotate the latter. However, in so doing, it will wedge the rollers 12 against the inside wall of the inlet tube 1 so that the index driver 11 and inlet tube are immediately locked together to function temporarily as a single entity. Thus, the main body 2 as a whole will tend to turn relative to the locked spiral and will index a single step as a result. Subsequently, as the main body 2 moves downwardly, the index driver 11 will be rotated in the opposite direction to that just mentioned and the rollers 12 will immediately be slidable relative the interior of the tube 1 so that no indexing of the main body 2 will take place in said opposite direction and no such indexing movements will occur until the main body 2 again rises. The continued reciprocation of the main body 2 indexes the whole assembly one step at a time and this action continues whilst the tank washer is supplied with liquid. Each of the three nozzle 7 oscillates through 60° but, since the whole nozzle assembly is rotated step-by-step through 360° around an axis substantially corresponding to the vertically disposed longitudinal axis of the tank washer, the result will be, as previously discussed, that the whole of the interior of the tank that is being cleaned will be covered by the jets of cleaning liquid, and subsequently rinsing liquid, that issue from the nozzles 7.

Since the indexing movement that has been briefly described is effected in one direction by the repeated locking of the rollers 12 on the inside of the recess in the inlet tube 1, that indexing movement will not exactly repeat a fixed number of index steps for each revolution about said substantially vertically axis since it is not a pawl and ratchet mechanism having a fixed number of teeth. This is important because it will immediately be appreciated that the jets issuing from the nozzles 7 will always describe a slightly different pattern of "stripes" on the interior of the wall of the tank being cleaned. Since, as just mentioned, constant tracking of these jets along the same path will not occur, the longer the tank washer is operated, the denser will be the stripes laid down by the jets and the more complete will be the cleaning action.

I claim:

1. A tank washer comprising a piston immovably connected, in operation, to liquid supply means, a body reciprocably surrounding said piston and at least one liquid ejection nozzle oscillatably connected to said body and a mechanism operable by the relative reciprocation between the body and the piston to index the body around an axis.

2. A tank washer according to claim 1, wherein three liquid ejection nozzles are provided, each such nozzle being capable of oscillation, in operation, through an arc of substantially 60° about a common axis, and said three arcs of oscillation being spaced apart from one another by successive angles of substantially 60°.

3. A tank washer according to claim 1, wherein the tank washer has a longitudinal axis, and the axis about which the body and hence said nozzle or nozzles are indexed, during operation, substantially corresponds to the longitudinal axis of the tank washer.

4. A tank washer according to claim 1, wherein the construction and arrangement are such that the indexing of the body around said axis which takes place during operation of the tank washer is effected in steps.

5. A tank washer according to claim 4, wherein the construction and arrangement are such that each step has a magnitude of substantially 10°.

6. A tank washer according to claim 4, wherein an index driver is provided having a hexagonal spiral and is movable relative to a matching spiral formed internally of a scroll so as to index the body of the tank washer in steps about said axis, the arrangement being such that said index driver is fitted with rollers which will enable slippage to take place readily in one direction of relative rotation and locking to take place in the opposite direction.

7. A tank washer according to claim 1, wherein during operation of the tank washer the at least one liquid ejection nozzle oscillates about an axis afforded by a nozzle tube contained in a transverse hole formed in the body of the tank washer, and wherein the nozzle tube which, during operation, oscillates the at least one liquid ejection nozzle, is connected to the liquid supply means by a coupling piece in such a way as to cause oscillation of the nozzle tube upon reciprocation of the body relative to the piston.

8. A tank washer according to claim 7, wherein said body reciprocates relative to the piston which occupies a fixed position relative to a tank that is to be cleaned, and wherein reciprocation of said body is brought about by applying liquid pressure successively to the opposite sides of said piston.

9. A tank washer according to claim 8, wherein a pivotally mounted valve member is provided by which liquid is fed successively via liquid supply conduits to the opposite sides of said piston, bleed holes being in provided adjacent each side of said piston for the exhaust of liquid from that region when the latter is not subject to liquid pressure, each bleed hole being smaller in size than is the liquid supply conduit to the region that is drained by the corresponding bleed hole.

10. A tank washer according to claim 9, wherein said valve member is loaded by the storage of energy in at least one spring and is subsequently triggered to move independently of the action that causes the triggering by releasing said at least one spring.

* * * * *